US006059326A

United States Patent [19]

Tramontina

[11] Patent Number: 6,059,326

[45] Date of Patent: May 9, 2000

[54] TAMPER RESISTANT ROTATIONAL LOCKING MECHANISM FOR AN ENCLOSURE

[76] Inventor: Paul F. Tramontina, 155 Cobblestone Way, Alpharetta, Ga. 30201

[21] Appl. No.: 08/883,944

[22] Filed: Jun. 27, 1997

[51] Int. Cl.[7] ..... E05C 1/12

[52] U.S. Cl. ..... 292/169; 292/98; 292/27; 292/124; 70/223; 70/422

[58] Field of Search ..... 292/6, 8, 11, 65, 292/111, 98, 169, DIG. 11, 124, 30, 31, 27, 120; 70/123, 422, 472, 223, 453, 454, 407, 375, 379 R, 419, 420, 416, 417; 403/305, 306, 300; 464/37, 38; 312/222

[56] References Cited

U.S. PATENT DOCUMENTS

| | | | |
|---|---|---|---|
| 1,339,823 | 5/1920 | Harbaugh . | |
| 1,423,336 | 7/1922 | Korittké . | |
| 1,568,901 | 1/1926 | Mickey . | |
| 2,229,596 | 1/1941 | Eilers . | |
| 2,498,508 | 2/1950 | Rudolph | 292/24 |
| 2,560,061 | 7/1951 | Agamaite, Jr. . | |
| 2,726,825 | 12/1955 | Ziskin et al. . | |
| 2,883,254 | 4/1959 | Bacca . | |
| 2,946,636 | 7/1960 | Penney . | |
| 3,095,249 | 6/1963 | Albrecht . | |
| 3,147,051 | 9/1964 | Birr et al. . | |
| 3,222,112 | 12/1965 | Bahnsen . | |
| 3,477,775 | 11/1969 | Trent | 312/209 |
| 3,510,055 | 5/1970 | Safford . | |
| 3,603,519 | 9/1971 | Brown et al. . | |
| 3,851,941 | 12/1974 | Stebe . | |
| 3,863,476 | 2/1975 | Patriquin | 70/419 |
| 3,865,323 | 2/1975 | Stronge et al. . | |
| 3,920,297 | 11/1975 | Brandes . | |
| 4,040,653 | 8/1977 | Takahashi | 292/202 |
| 4,047,775 | 9/1977 | Wolbrink . | |
| 4,104,898 | 8/1978 | Fois | 70/419 |
| 4,223,965 | 9/1980 | Palandrani . | |
| 4,408,811 | 10/1983 | Richardson et al. . | |
| 4,611,768 | 9/1986 | Voss et al. . | |
| 4,718,704 | 1/1988 | Verhoog | 292/169 |
| 4,958,864 | 9/1990 | Fischer et al. . | |
| 5,154,496 | 10/1992 | Campbell et al. . | |

FOREIGN PATENT DOCUMENTS

| | | |
|---|---|---|
| 0250256A2 | 12/1987 | European Pat. Off. . |
| 892041 | 3/1944 | France . |
| 2141478 | 12/1984 | United Kingdom . |
| 2272016 | 5/1994 | United Kingdom . |
| 2281585 | 3/1995 | United Kingdom . |
| WO 97/11630 | 4/1997 | WIPO . |

*Primary Examiner*—Lloyd A. Gall
*Assistant Examiner*—Clifford B Vaterlaus

[57] ABSTRACT

A simple and low cost locking mechanism that is unlocked by a simply configured key while protecting against tampering through limited access and unique geometry. Access is limited by a spin bushing that guards access to a cam twister having a keyhole with a unique star geometry.

10 Claims, 6 Drawing Sheets

TAMPER RESISTANT ROTATIONAL LOCKING MECHANISM FOR AN ENCLOSURE

BACKGROUND OF THE INVENTION

The present invention relates to locking mechanisms that are simple and low cost and more particularly to such locking mechanisms that also resist being unlocked by means of tampering without the required key.

Simple, low cost locking mechanisms such as are used to lock washroom dispensers for example, can be unlocked by means of a camming motion induced by the rotation of a key into a cam twister component. Such cam twister components can have a surface that is exposed to the public and can contain a square-shaped recess matching the square-shaped cross-section of the key. While proving to be cost effective and easy to use, this lock design is subject to being unlocked by tampering without the key. The locking mechanism could be activated without the key by using one's finger on the publicly exposed surface of the cam twister or by sticking an object such as a pen, pencil or screwdriver into the square-shaped recess and rotating. The friction between the surface of the cam twister and one's finger (or the object) often proved sufficient to allow the application of enough torque to rotate the cam twister and thus unlock the mechanism without the key.

OBJECTS AND SUMMARY OF THE INVENTION

It is a principal object of the present invention to provide a locking mechanism that is simple and low cost yet resistant to being unlocked by means of tampering without the required key.

It is another principal object of the present invention to provide a rigid enclosure with an access door that is secured by a locking mechanism that is simple and low cost yet resistant to being unlocked by means of tampering without the required key.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the locking mechanism of the present invention is contained within part of a rigid enclosure and secures access to the interior of this enclosure. Access to the interior of the enclosure may be provided by a door defining part of the enclosure and having an interior surface facing the interior space of the enclosure when closed. At least one hook member can extend from the interior surface of the door.

The locking mechanism includes a spin bushing, a star cam twister, and a latch member. The latch member can be configured and disposed so that axial movement of the latch member, unlocks the locking mechanism. The latch member can include at least one hook member configured and disposed to engage a corresponding hook member on the door to secure the door and close access to the interior space of the enclosure.

The star cam twister provides a rotational member configured with an axial recess that receives the key. The star cam twister is rotatably disposed relative to the rigid enclosure and held against axial movement relative thereto.

The spin bushing is rotatably disposed relative to the rigid enclosure and held against axial movement relative thereto. The spin bushing is spaced apart from the star cam twister so that rotation of the spin bushing cannot rotate the star cam twister. However, the spin bushing has an axially extending through hole that is aligned with the axial recess of the star cam twister.

The geometry of the recess of the star cam twister and the geometry of the through hole in the spin bushing are complementary such that any key conforming to the geometry of the spin bushing's through hole, can be inserted into the recess of the star cam twister in a manner that permits the key to rotate the star cam twister. One end of the latch member is configured to engage one end of the star cam twister so that rotation of the star cam twister causes axial movement of the latch member. However, a means is provided for axially biasing the latch member in the locked position. The latch member can be configured and disposed so that axial movement of the latch member against the biasing means, unlocks the locking mechanism.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

The locking mechanism of the present invention desirably is used to secure access to the interior of a rigid enclosure and has its locking components housed within said enclosure. The present invention desirably functions in a locking mechanism wherein axial movement of the latch member selectively produces the transformation of the operational mode of the locking mechanism from locked to unlocked and vice versa. Moreover, in a locking mechanism according to the present invention, rotational motion of the key produces the desired unlocking motion of the latch member by means of a configuration of cams interacting between the latch member and a rotational member that receives the key. In addition, the locking mechanism is capable of functioning regardless of its orientation relative to the direction of the force of gravity.

Figure 1:
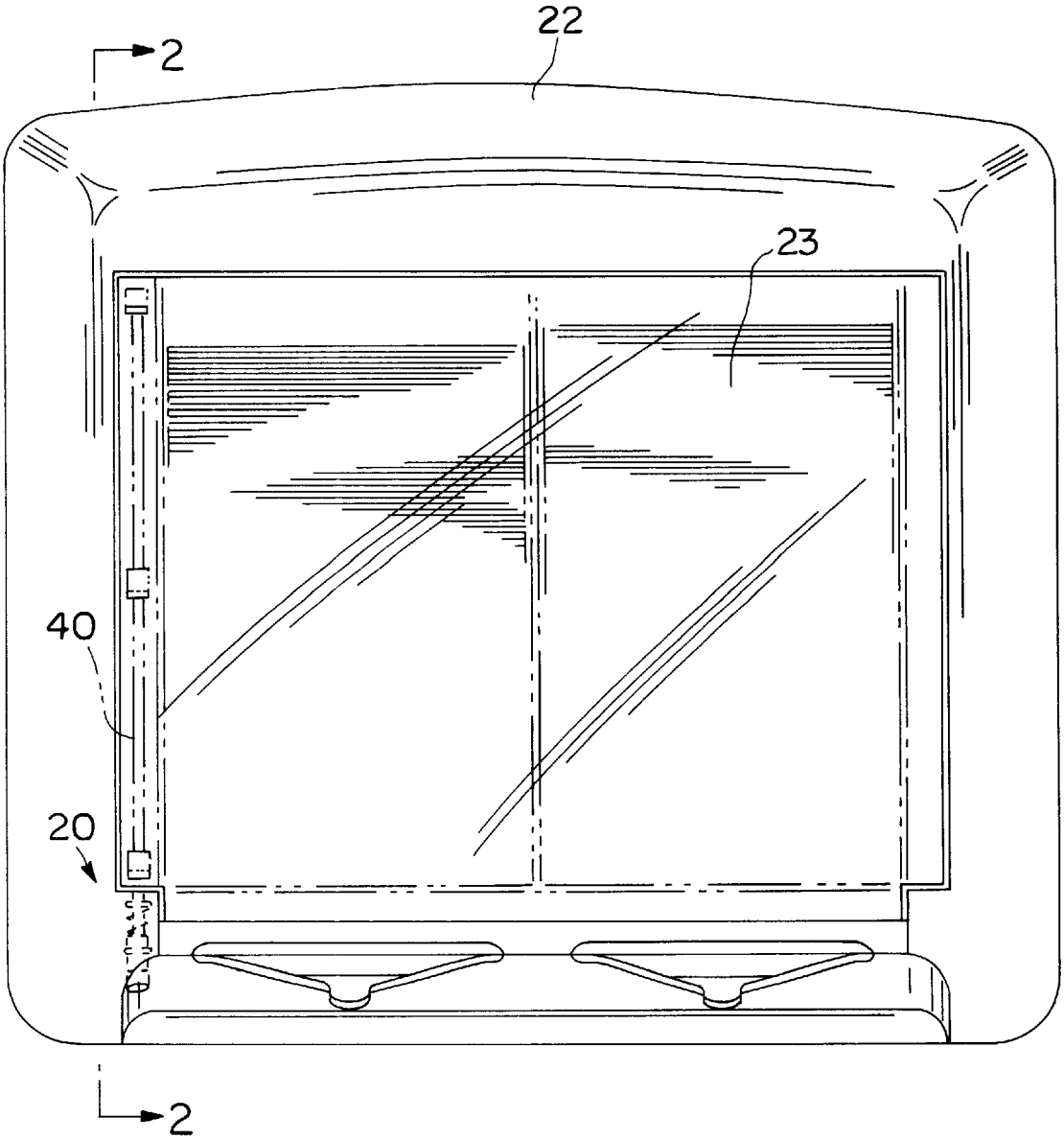
FIG. 1 is a front plan view of a presently preferred embodiment of the present invention in an embodiment of a wall mounted dispenser of paper products, with portions shown in chain-dashed line to indicate disposition behind a solid member in the view shown.
Figure 2:
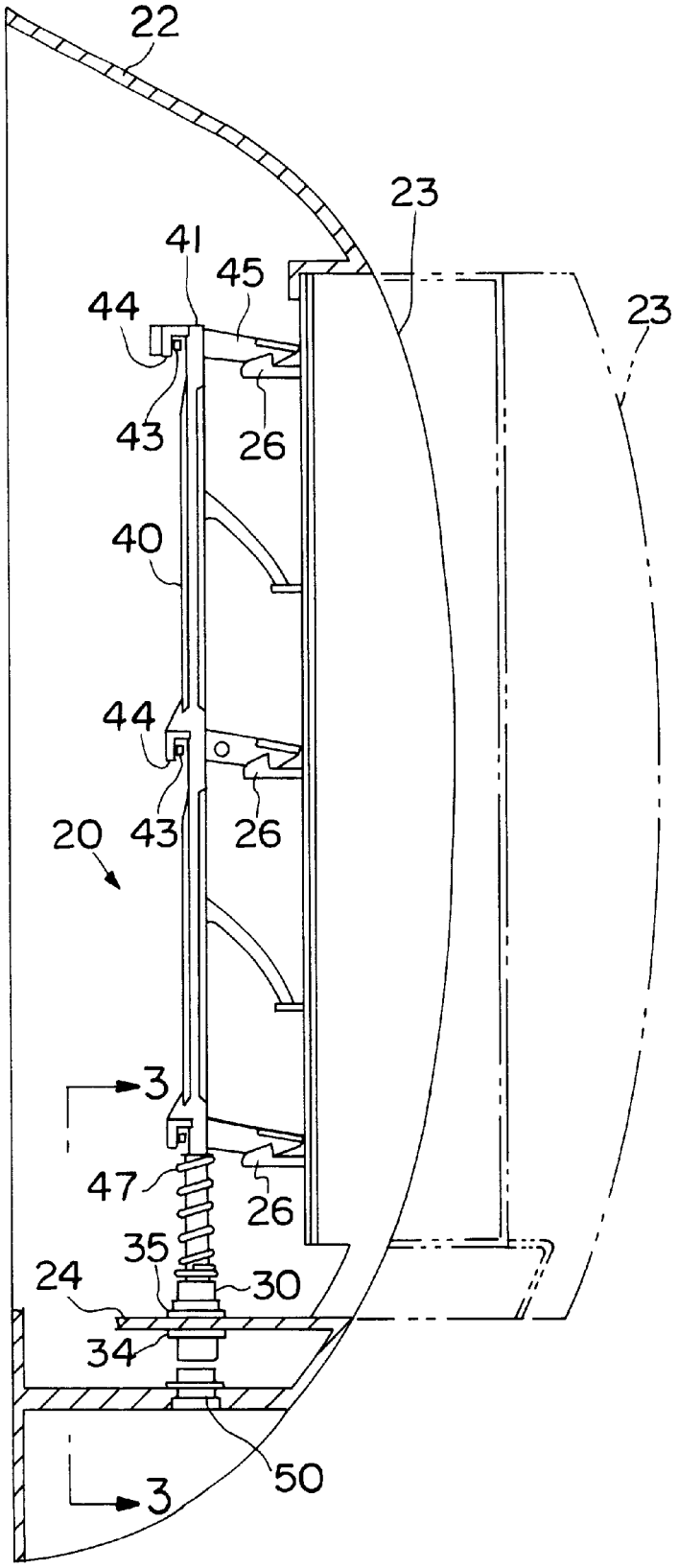
FIG. 2 is a partial cross-sectional and partial side plan view taken from the perspective looking in the direction of arrows numbered 2—2 in FIG. 1, with portions shown in chain-dashed line to indicate an open disposition of the door component.

A presently preferred embodiment of the locking mechanism according to the present invention is shown in solid lines in FIG. 2 and dashed lines in FIG. 1 and is represented generally by the numeral 20. The locking mechanism is contained within part of a rigid enclosure, which takes the form of a dispenser 22 of paper towels in the embodiment shown in FIG. 1. Dispenser 22 is formed of rigid plastic material and has a clear plastic door 23 that is hinged near the side of door 23 opposite mechanism 20. Door 23 is latched shut near mechanism 20. As shown in dashed line in FIG. 2, door 23 opens away from the plane of FIG. 1 and toward the viewer by pivoting about the hinge (not visible in the view shown in FIGS. 1 and 2). As shown in FIG. 2, door 23 has at least one hook member 26, and desirably three hook members 26 are symmetrically disposed along the height of the surface of door 23 that faces the interior of dispenser 22 and adjacent locking mechanism 20. Other than the components dealing more particularly with locking mechanism 20 to be described more fully below, the remaining components of dispenser 22 are configured, positioned and function as described in application Ser. No. 08/534,179, which is hereby incorporated herein by this reference.

Figure 5:
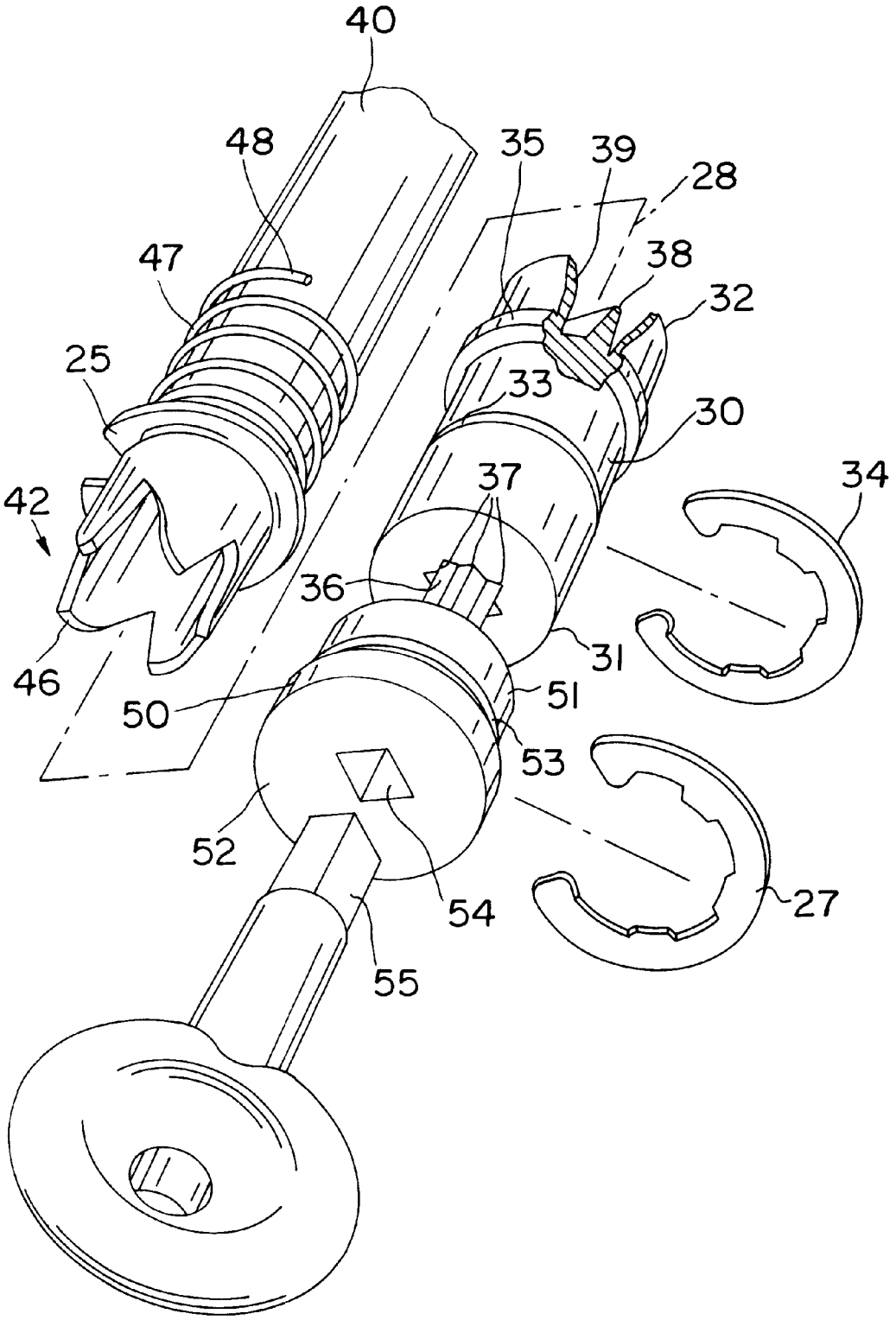
FIG. 5 is an elevated perspective assembly view of components and portions thereof of a presently preferred embodiment of the invention.
Figure 6:
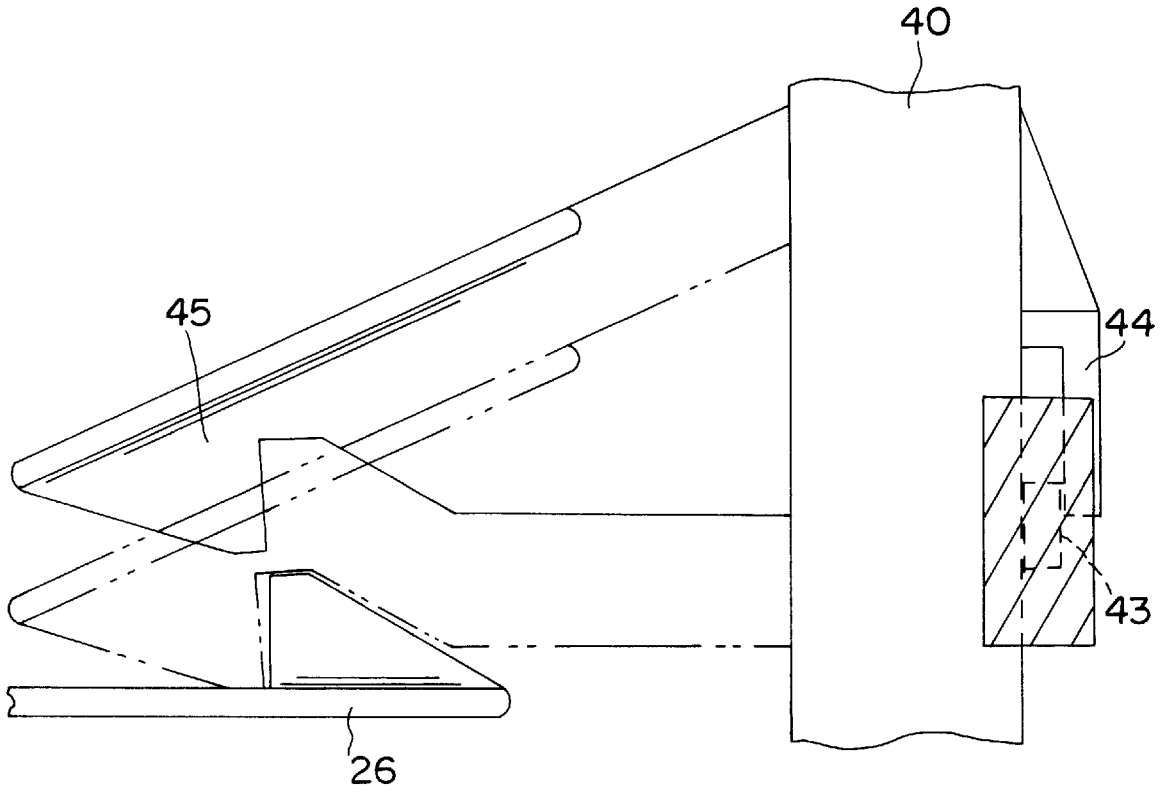
FIG. 6 is a partial side plan view of components shown in FIG. 4 taken from the perspective looking in the direction of arrows numbered 6–6 in FIG. 4, with the locked position shown in chain-dashed line and the unlocked position shown in solid line.

The locking mechanism of the present invention includes a star cam twister that provides a rotational member configured with an axial recess that receives the key. As shown in FIG. 5 for example, a star cam twister 30 defines a longitudinal axis 31. Star cam twister 30 is desirably formed as a component shaped with cylindrical symmetry disposed about central longitudinal axis 28. Thus, star cam twister 30 defines a first axially extending member having a first end 31 and a second end 32 disposed opposite the first end. A circumferentially extending groove 33 is formed in the exterior surface of star cam twister 30 and oriented about midway between first end 31 and second end 32. As shown in FIG. 5, groove 33 is configured to rotatably receive a retainer clip 34.

Figure 3:
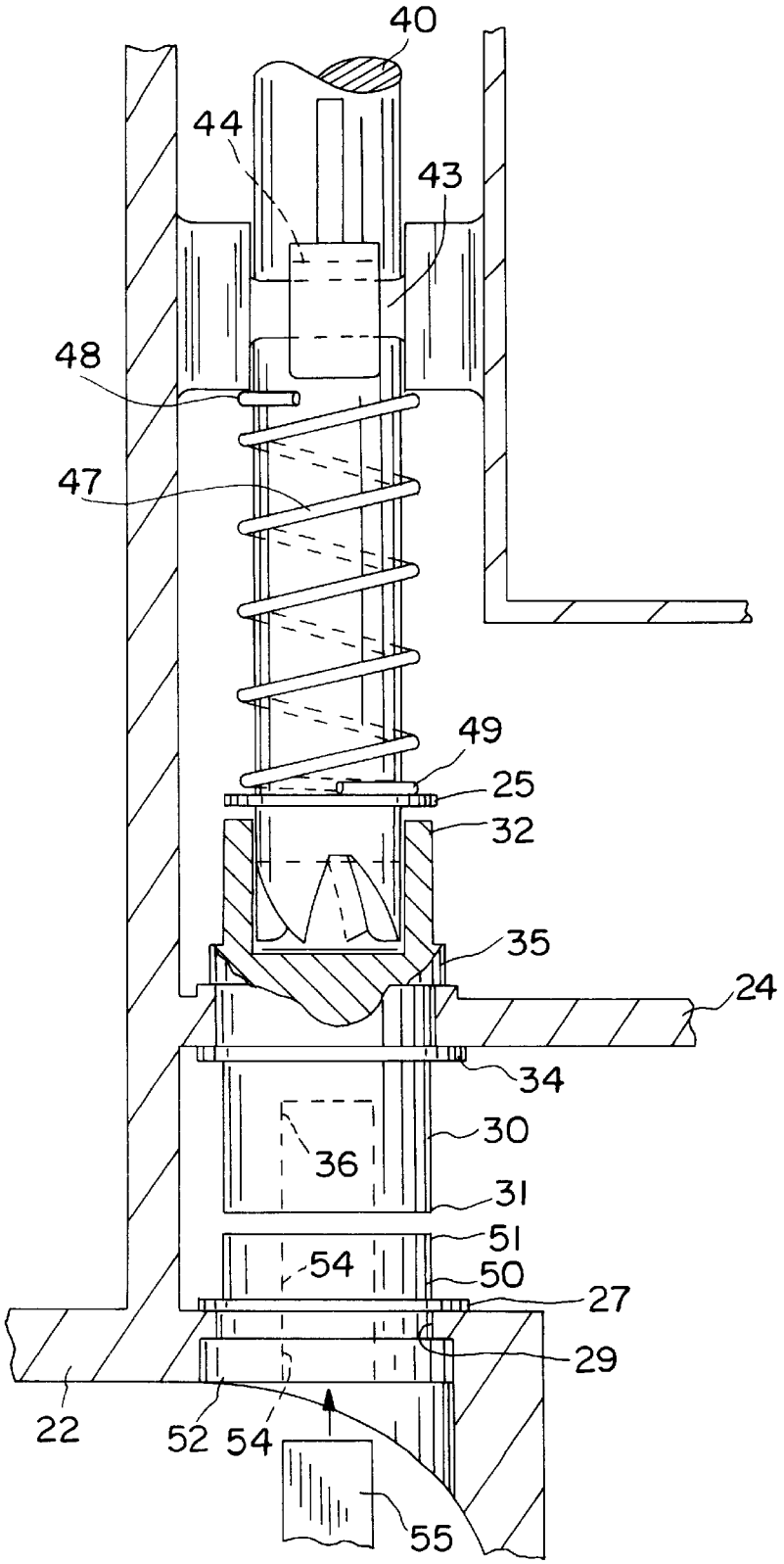
FIG. 3 is a partial cross-sectional and partial side plan view taken from the perspective looking in the direction of arrows numbered 3—3 in FIG. 2.
Figure 4:
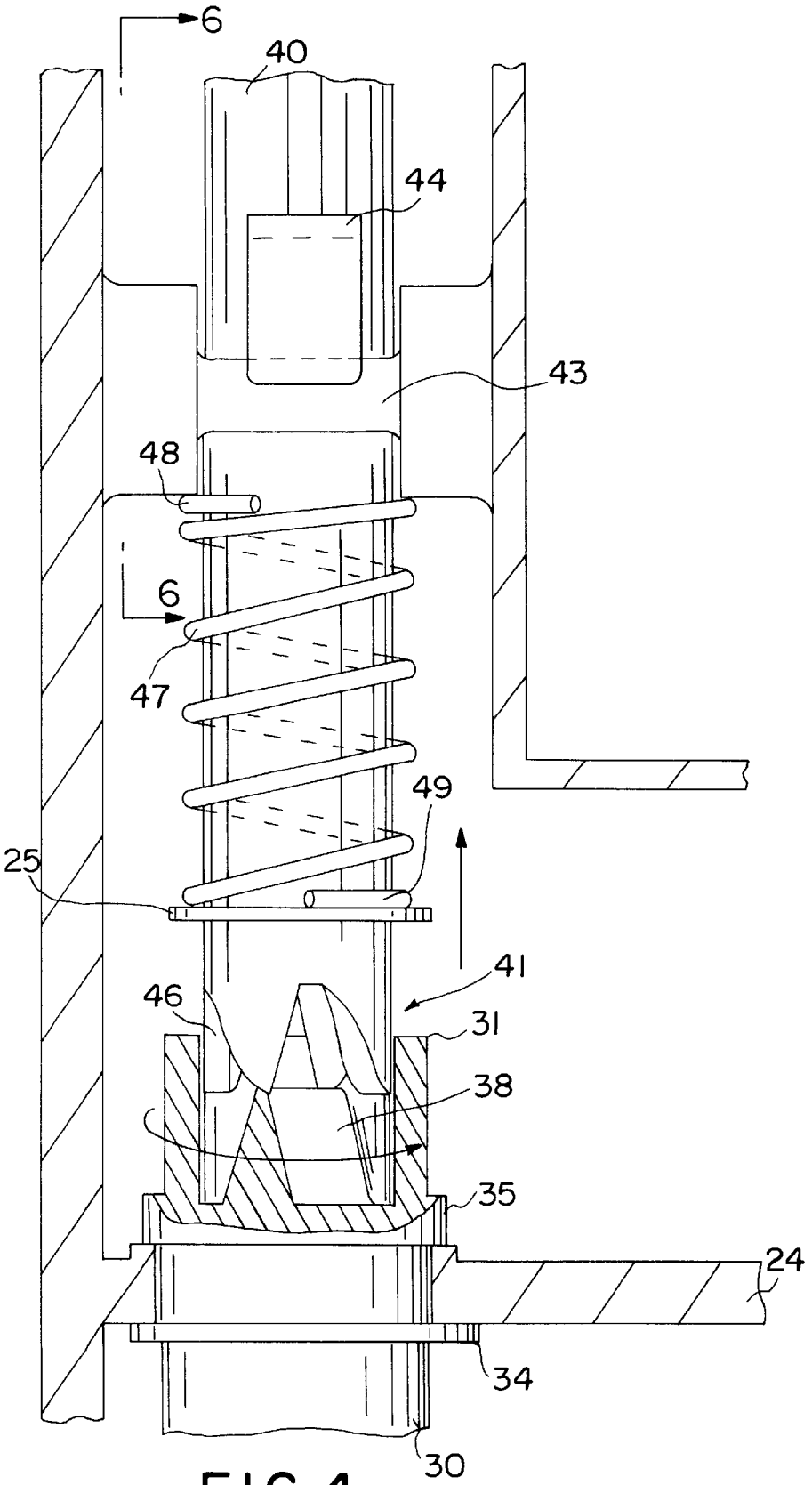
FIG. 4 is a partial cross-sectional and partial side plan view taken from the perspective similar to that shown in FIG. 3.

As shown in FIGS. 2–4 for example, star cam twister 30 is rotatably held in the interior space of the rigid enclosure formed by dispenser 22. As shown in FIGS. 3 and 4 for example, first end 31 of twister 30 is passed through an opening with a circular cross-section formed in a flange 24 that in turn forms part of the interior of dispenser 22. Star cam twister 30 is rotatably held by retainer 34 and a shoulder 35. As shown in FIG. 5 for example, shoulder 35 is integrally formed as part of the outer surface of twister 30 and extends circumferentially therearound. Retainer 34 and shoulder 35 prevent axial movement of star cam twister 30 relative to dispenser 22 but permit rotational movement relative thereto.

As shown in FIGS. 3 and 5, an axially extending first opening 36 is defined as a recess in first end 31 of star cam twister 30. The transverse cross-sectional shape of first opening 36 is in the configuration of a star that has squared apexes 37, i.e., apexes 37 forming a right angle. As shown in FIGS. 4 and 5, second end 32 of star cam twister 30 is configured with an axially extending first cam member 38 surrounded by a cylindrical wall 39. First cam member 38 is configured for engaging a cam receiving member 46 (described below) whereby rotation of the cam receiving member by first cam member 38 effects opening of the locking mechanism. As shown in FIGS. 4 and 5, first cam member 38 has a generally triangular profile in an axial cross-section.

As shown in FIG. 1 for example, an axially extending latch member 40 is mounted for axial movement relative to the interior of the rigid enclosure formed by dispenser 22. As shown in FIG. 2 for example, each of a plurality of spaced apart ribs 43 formed in dispenser 22 is slidably received in a corresponding C-track 44, which is integrally formed along the length of latch member 40. As shown in FIG. 2, latch member 40 has at least one hook member 45 configured in a first end 41 to selectively engage and disengage a mating hook member 26 to respectively lock and unlock the locking mechanism. Three hook members 45 are provided in the embodiment shown and are spaced at equal intervals along the length of latch member 40.

As shown in FIGS. 4 and 5 for example, latch member 40 has a second end 42 that is configured with a cam receiving member 46 for engaging the first cam member 38 of star cam twister 30. Cam receiving member 46 is configured so that rotation of cam member 38 results in axial movement of latch member 40 as cam member 38 rides along the undulating surface of cam receiving member 46.

A means is provided for biasing the latch member against axial movement, which axial movement is produced by rotation of the first cam member 38 to ride on cam receiving member 46. As embodied herein and shown in FIG. 2 for example, a means for biasing the latch member 40 against such axial movement caused by rotation of the first cam member 38, can include a compression spring 47. As shown in FIG. 3, at least one portion of spring 47, in this case a first end 48 of spring 47, is fixed against axial movement relative to the rigid enclosure. As shown in FIGS. 3 and 4 for example, another portion of spring 47, in this case a second end 49 of spring 48, which second end 49 is disposed opposite first end 48 of spring 47, butts against a retainer 25 connected to latch member 40. So configured and disposed, spring 47 biases latch member 40 so as to remain in the locked position, which is effected as each hook member 45 of latch member 40 engages its corresponding mating hook member 26.

The locking mechanism of the present invention further includes a spin bushing. As shown in FIGS. 3 and 5, a spin bushing 50 defines a second axially extending cylindrically-shaped member having a first end 51 and a second end 52 disposed opposite the first end. As shown in FIGS. 3 and 5, spin bushing 50 is rotatably held by a retainer 27 in the interior space of the rigid enclosure. As shown in FIG. 3, second end 52 of spin bushing 50 is nested in a countersunk portion of an opening 29 through the outer wall of dispenser 22. Retainer 27 is fixed to a groove 53 (FIG. 5) around the circumference of spin bushing 50 and butts against the interior side of the outer wall of dispenser 22, which is the interior of the rigid enclosure, and allows spin bushing 50 to rotate freely within the opening in the outer wall of dispenser 22.

As shown in FIG. 3, first end 51 of spin bushing 50 is disposed apart from and facing the first end 31 of star cam twister 30. An axial gap, which at a minimum should be 1/16 of an inch, must be maintained between the spin bushing 50 and the star cam twister 30. As shown in FIGS. 3 and 5, first end 51 of spin bushing defines an axially extending second opening 54 that forms a second recess therein. As shown in FIG. 3 for example, second opening 54 is aligned with first opening 36. Moreover, as shown in FIGS. 3 and 5, the transverse cross-sectional shape of second opening 54 is configured so that it can be non-rotatably received within the star-shaped cross-sectional shape of the first opening 36 of the star cam twister. In other words, a key 55 that is configured with the same transverse cross-sectional shape as second opening 54, has a shape that can be inserted into first opening 36 and held non-rotatably within first opening 36 of star cam twister 30. In the embodiment shown, a squared-apex, star geometry has been chosen for the first opening 36, and a complementary square geometry has been used for the second opening 54 and for the key 55. However, other complementary geometries could be used to achieve the same effect. For example, an equilateral triangle-apex, star geometry could be used for the first opening 36, and a complementary equilateral triangle geometry could be used for the second opening 54 and for the key 55.

In operation, axial movement of the latch member 40 selectively produces the transformation of the operational mode of the locking mechanism from locked to unlocked and vice versa. The star cam twister 30, retainers 25, 27, 34, latch member 40, compression spring 47, spin bushing 50, and key 55, are shown in an assembly view in FIG. 5. Except for the key 55, all of these components are enclosed within the rigid structure 22, which in this case happens to be a paper towel dispenser. The only exposed surface of the mechanism is one circular-shaped second end 52 of the spin bushing 50, which has a square through hole 54. The spin bushing 50 is held securely in place by retainer 27 within the opening 29 in the enclosure 22. However, spin bushing 50 is able to rotate freely a full 360 degrees in either the clockwise or counter-clockwise direction. Located axially in line with but spaced apart from a first end 51 of spin bushing 50, is the star cam twister 30. The first opening 36 of star cam twister 30 is positioned such that the star geometry (FIG. 5) faces toward and axially aligned with the square through hole 54 of spin bushing 50. The second end 32 of star cam twister 30 contains the cam member 38, which engages the cam receiving member 46 of the latch member 40.

The retainer 34 holds the star cam twister 30 securely within the enclosure 22 and precludes star cam twister 30 from axial movement relative to the enclosure and the spin bushing 50. However, the retainer 34 allows star cam twister 30 to rotate about its central axis a full 360 degrees, either clockwise or counter-clockwise, when subjected to a torque of at least 6 in-lbs. The amount of torque required to effect rotation of star cam twister 30 is a function of the strength of the compression spring 47, which applies the axially directed force that governs how much torque must be applied to axially displace latch member 40.

To operate the rotational locking mechanism of the present invention, the key 55 is inserted into the spin bushing 50, which has a through hole 54 matching the transverse cross-sectional shape and size of the key 55. With the key inserted only into the second opening 54 of the spin bushing 50, rotating the key 55 at this point will not unlock the mechanism, because only the spin bushing 50 will rotate. The key 55 must be further inserted axially until the key hits the star geometry of the first opening 36 of star cam twister 30. At this point, rotating the key 55 will cause the square cross section of the key 55 to align itself with one of the eight possible squared mating positions within the star cam twister 30. At this point, key 55 will become held non-rotatably with respect to star cam twister 30, and a minimum torque of about 6 in-lbs will rotate the star cam twister 30 and thus allow the rotational lock mechanism to become unlocked and accordingly unlock the enclosure of the illustrated embodiment.

To understand the tamper proofing features of the invention, consider the following. Once a would-be tamperer determines that the spin bushing 50 is the access point for the locking mechanism, the tamperer may try to unlock the mechanism by applying an axially directed force into the second opening 54 of the spin bushing 50. However, the tamperer's action fails to have the intended unlocking effect. Rotating the spin bushing 50 with one's finger simply rotates the spin bushing 50. The axial gap between the spin bushing 50 and star cam twister 30 prevents the transmission of rotational motion via frictional engagement between the two components.

If the tamperer forces a tapered object such as a pen, pencil or screwdriver blade into the square-shaped opening 54 of the spin bushing 50 and rotates the spin bushing, the same futile effect is produced. Rotating the spin bushing 50 does not cause rotation of the star cam twister 30. This same ineffective result occurs upon forcing any object larger than the opening 54 into the spin bushing 50.

Any object which is smaller than the opening 54 in the spin bushing 50, no matter what the shape, will successfully travel through the spin bushing 50 and, if axially-directed motion toward the spin bushing is continued, will make contact with the star cam twister 30. However, since the object is smaller than the second opening 54 in the spin bushing 50, rotation of said object will not allow it to engage into any of the locking positions in the first opening 36 of the star cam twister 30. The star cam twister requires an object the exact size and shape of the key 55. Thus, the tampering object will simply rotate within the first opening 36 of the star cam twister 30 without rotating the star cam twister. Any frictional forces that can develop, would not be substantial enough to overcome the rotational resistance supplied by the compression spring 47.

The same result occurs with an object that is smaller overall and of different cross section than the opening 54 in the spin bushing 50 but has one edge the same size of the opening 54. An example would be knife, or a straight blade screwdriver or, however unlikely, a triangular shaped tool.

By incorporating the spin bushing 50 together with the uniquely positioned and configured star cam twister 30 with its first opening 36 having a geometry compatible with the second opening 54 of bushing 50, the locking mechanism of the present invention resists being unlocked by any means other than with the intended key 55 having the corresponding geometry.

While a preferred embodiment of the invention has been described using specific terms, such description is for illustrative purposes only, and it is to be understood that changes and variations may be made without departing from the spirit or scope of the following claims. In the illustrative embodiment shown in the drawings, the spin bushing and the star cam twister are shown functioning with a rotational locking mechanism, which is described in more detail in application Ser. No. 08/534,179, which is hereby incorporated herein by this reference. However the novelty of these components can be applied to other rotational type locking mechanisms as well. These new components prevent activation of the rotational locking mechanism, except through the use of the approved key (FIG. 5), as explained above for example.

What is claimed is:

1. A tamper-resistant locking mechanism for restricting access to the interior space of a rigid enclosure, comprising:

a star cam twister defining a longitudinal axis, said star cam twister defining a first axially extending member having a first end and a second end disposed opposite said first end, said first end of said star cam twister being configured with an axially extending first opening having a star-shaped transverse cross-sectional shape, said second end of said star cam twister being configured with an axially extending first cam member, said star cam twister being rotatable, said cam member being configured for engaging a cam receiving member;

a spin bushing, said spin bushing being rotatable, said spin bushing defining a second axially extending member having a first end and a second end disposed opposite said first end, said spin bushing defining an axially extending second opening having a transverse cross-sectional shape that can receive a key therein and allow said key to pass therethrough to be received within and held non-rotatably by said star-shaped cross-sectional shape of said first opening of said star cam twister, said first end of said spin bushing being disposed apart from and facing said first end of said star cam twister said disposition of said spin bushing with respect to said star cam twister defining an axial gap between said spin bushing first end and said star cam twister first end, said axial gap preventing said star cam twister from contacting said spin bushing; and an axially extending latch member having a first end configured to selectively engage and disengage a hook member, said latch member having a second end being configured with a cam receiving member for receiving said first cam member.

2. A mechanism as in claim 1, wherein said first cam member and said cam receiving member are configured so that rotation of said first cam member causes axial movement of said latch member.

3. A mechanism as in claim 2, further comprising:

a means for biasing said latch member against axial movement upon rotation by said first cam member.

4. A mechanism as in claim 3, wherein said means for biasing said latch member against axial movement, includes a spring.

5. A rigid enclosure with a tamper-resistant locking mechanism for restricting access to the interior space of the enclosure, comprising:

a wall defining the rigid enclosure and surrounding the interior space thereof;

a star cam twister defining a first longitudinal axis, said star cam twister defining a first axially extending member having a first end and a second end disposed opposite said first end, said first end of said star cam twister being configured with an axially extending first opening having a star-shaped transverse cross-sectional shape, said second end of said star cam twister being configured with an axially extending first cam member, said star cam twister being rotatably held in the interior space surrounded by said wall of the rigid enclosure, said cam member being configured for engaging a cam receiving member;

a spin bushing, said spin bushing being rotatably held in the interior space surrounded by said wall of the rigid enclosure, said spin bushing defining a second axially extending member having a first end and a second end disposed opposite said first end, said spin bushing defining an axially extending second opening having a transverse cross-sectional shape that can receive a key therein and allow said key to pass therethrough to be received within and held non-rotatably by said star-shaped cross-sectional shape of said first opening of said star cam twister, said first end of said spin bushing being disposed apart from and facing said first end of said star cam twister said disposition of said spin bushing with respect to said star cam twister defining an axial gap between said spin bushing first end and said star cam twister first end, said axial gap preventing said star cam twister from contacting said spin bushing;

a door defined in said wall and having an interior surface facing the interior space when closed, said door defining at least one hook member extending from said interior surface; and an axially extending latch member having a first end configured to selectively engage and disengage said hook member, said latch member having a second end being configured with a cam receiving member for receiving said first cam member.

6. A rigid enclosure as in claim 5, wherein said cam member and said cam receiving member are configured so that rotation of said first cam member causes axial movement of said latch member.

7. A rigid enclosure as in claim 6, further comprising:

a means for biasing said latch member against axial movement upon rotation by said first cam member.

8. A rigid enclosure as in claim 7, wherein said means for biasing said latch member against axial movement, includes a spring having at least one portion fixed against axial movement relative to the rigid enclosure.

9. A rigid enclosure as in claim 5, wherein said enclosure is a washroom dispenser.

10. A rigid enclosure as in claim 5 wherein said enclosure is a dispenser for paper towels.

* * * * *

UNITED STATES PATENT AND TRADEMARK OFFICE

CERTIFICATE OF CORRECTION

PATENT NO : 6,059,326

DATED : May 9, 2000

INVENTOR(S) : Tramontina

It is certified that error appears in the above-identified patent and that said Letters Patent are hereby corrected as shown below:

Please add on the face of the Patent:

Assignee:

Kimberly-Clark Worldwide, Inc.
401 North Lake St.
Neenah, Wisconsin 54956

Signed and Sealed this

Eighth Day of May, 2001

*Attest:*

Nicholas P. Godici

NICHOLAS P. GODICI

*Attesting Officer*

*Acting Director of the United States Patent and Trademark Office*